US005383343A

United States Patent [19]

Thach

[11] Patent Number: 5,383,343

[45] Date of Patent: Jan. 24, 1995

[54] HEART TOOL PENDANT

[76] Inventor: Chris H. Thach, 3525 Keith St. NW., Suite L, Cleveland, Tenn. 37312-4354

[21] Appl. No.: 235,544

[22] Filed: Apr. 29, 1994

[51] Int. Cl.[6] ..... A44C 13/00

[52] U.S. Cl. ..... 63/1.1; 63/21; 70/456 R

[58] Field of Search ..... 63/1.1, 18, 21; 70/456 R, 459; D3/207, 208, 210, 211, 212

[56] References Cited

U.S. PATENT DOCUMENTS

| | | | |
|---|---|---|---|
| D. 56,168 | 8/1920 | Berry et al. | D3/211 |
| D. 250,932 | 1/1979 | Anderson . | |
| D. 292,502 | 10/1987 | Croker et al. . | |
| D. 305,216 | 12/1989 | Aucoin . | |
| 1,510,420 | 9/1924 | Sherman | 63/1.1 |
| 1,924,134 | 8/1933 | Segal | D3/212 |
| 2,569,629 | 10/1951 | Everitt | D3/208 |
| 2,600,749 | 6/1952 | Gallagher | D3/207 |
| 2,908,156 | 10/1959 | Preston | 70/456 R |
| 4,048,824 | 9/1977 | Blackmon . | |
| 4,079,606 | 3/1978 | Svihovec . | |
| 4,079,607 | 3/1978 | Spruyt | D3/207 |
| 4,306,433 | 12/1981 | Kelly . | |
| 4,389,864 | 6/1983 | Toyoda | 70/456 R |
| 4,660,397 | 4/1987 | Girimont | 70/456 R |
| 4,936,123 | 6/1990 | Matsuda | 70/456 R |
| 5,117,666 | 6/1992 | Keefer . | |
| 5,123,579 | 6/1992 | Sugiyama | 70/456 R |
| 5,134,862 | 8/1992 | Giehl . | |
| 5,209,089 | 5/1993 | Nelson . | |

*Primary Examiner*—Michael J. Milano
*Attorney, Agent, or Firm*—Sheldon & Mak

[57] ABSTRACT

A decorative tool pendant includes a frame having opposite faces and a perimeter surface, first and second intersecting passages extending through the frame, the first passage extending between spaced locations of the perimeter surface; a tool having an elongate envelope and being slidable within the first passage, the tool being sufficiently long for projecting simultaneously from opposite ends of the first passage, a tool surface being formed within the envelope for operation with a workpiece, the tool being formed with a passage forming a locating surface extending between opposite sides of the tool. The tool is locatable with the locating surface aligned with the second passage of the frame in a first position wherein at least a portion of the tool surface is located within the perimeter surface of the frame, and a second position wherein the tool surface is fully exposed for operating the lock. The frame has an opening formed between the opposite faces of the perimeter surface, the first passage being interrupted by the opening for partially exposing the tool in the first position thereof. A connector selectively retains the tool in one of the two positions, the connector engaging the second passage of the frame and the locating surface of the tool. A connector passage extends through the connector for suspending the pendant by an external device when the tool is located in the first position. An exemplary form of the tool is a spare key, the pendant depicting an unlocked heart in the first position.

14 Claims, 1 Drawing Sheet

HEART TOOL PENDANT

BACKGROUND

The present invention relates to jewelry for wearing on a person's body, and more particularly to an ornamental pendant including a tool that can be a spare key.

There are many situations in which a person has a need to carry a tool such as a spare key, such as for unlocking a house or car. For example, when doing outside activities, it can be cumbersome to carry a key or set of keys because at times it may be necessary to put the keys down, making it possible for the keys to be mislaid or lost. While the keys can be placed in a pocket of the person's clothing, not all clothing has pockets. Further, the person may be doing an activity, such as working out at a gym, in which it would be uncomfortable for the person to carry the keys in a pocket.

There are several methods for carrying spare keys. For example, U.S. Pat. No. 4,079,606 to Svihovec discloses an emergency bendable key bendable adapted to be worn as a ring. In order to use the key, the user must unbend the key by using a tool or stepping on it. The key can then be rebent into the ring shape. The main disadvantage of this method for carrying a key is that after a few straightenings bendings, the key would break, thus making it necessary to get another. Also, it may be difficult to sufficiently straighten the key for operating a lock.

U.S. Pat. No. 4,048,824 to Blackmon discloses an ornamental openable housing for removably holding a house key, the housing being suspended around the neck of a person by a neck chain. One disadvantage of this method is that the key must be completely removed from the housing in order to be used. Also, the housing could come open causing the key to fall out.

U.S. Pat. No. 5,117,666 to Keefer discloses a key support apparatus including a housing for pivotally mounting first and second key holders at opposite ends. The key holders are spring biased for rotation within the apparatus and are maintained in a first position by a latch and released to a second position upon release of the latch. As with carrying a key chain, this apparatus is not worn on the person, making it possible for it to be lost or mislaid, or inconvenient to put into a pocket. Also, operation of the apparatus is cumbersome, subjecting a user's fingers to potential injury during use, in that the keys are not locked in the second position, and the pivotal movement between the two positions is a potential source of pinching.

Similarly, typical carriers for other tools such as knives and files fail to effectively lock the tool component in an extended position and/or have pivoting movements that can produce injury by pinching or the like.

Thus there is a need for a way to carry a tool such as a spare key that avoids the disadvantages of the prior art.

SUMMARY

The present invention meets this need by providing a decorative tool pendant for carrying a spare tool such as a key. In one aspect of the invention, the pendant includes a frame member having first and second intersecting passages extending therethrough; a tool member having an elongate cylindrical envelope, a tool surface being formed within the envelope for operation on a workpiece. A locating surface extends between opposite sides of the tool member, the tool member being engageable with the frame member with portions of the tool member that are coincident with the cylindrical envelope contacting the first passage of the frame member, with the locating surface aligned with the second passage of the frame member in a first position of the tool member wherein at least a portion of the tool surface is located within a perimeter surface of the frame member, and a second position wherein the tool surface is fully exposed for use on a workpiece. A connector selectively retains the tool member in one of the two positions, the tool member engaging the second passage of the frame member and the locating surface of the tool member, a connector passage extending through the pendant for suspension thereof by an external device when the tool member is located in the first position by the connector. Thus the first position provides a compact configuration wherein the tool surface is protected by the frame member, the tool member being fixedly locked relative to the housing in the second position for facilitating operation with a workpiece.

The frame member can have an opening formed between opposite face portions of the perimeter surface, the first passage being interrupted by the opening for partially exposing the tool member in the first position thereof. The frame member can form a closed loop about the opening. Preferably the frame member is heart-shaped for a pleasing ornamental appearance.

The first passage can be cylindrical, the tool member being axially slidable within the first passage. The first passage can extend between opposite extremities of the frame member, the tool member preferably being sufficiently long for projecting simultaneously from opposite ends of the first passage, thereby facilitating movement of the tool member between the first and second position.

In another aspect of the invention, the pendant includes the frame member having first and second intersecting passages extending therethrough; the connector; and a key member having an elongate cylindrical envelope, a key profile being formed within the envelope for unlocking a lock when the key member is operated with the lock. The key member is formed with the locating surface extending between opposite sides thereof, the key member being engageable with the frame member in the first position wherein at least a portion of the key profile is located within a perimeter surface of the frame member, and the second position wherein the key profile is fully exposed for operating the lock. Thus the first position provides a compact configuration wherein the key profile is protected by the frame member, the key member being fixedly locked relative to the housing in the second position for facilitating operation with a lock, the pendant being suspendable on the external device.

The frame member can have the opening for partially exposing the key member in the first position thereof. The frame member can form the closed loop about the opening. Preferably the frame member is heart-shaped for depicting an unlocked heart when the key member is in the first position.

The first passage can be cylindrical, the key member being axially slidable within the first passage. The first passage can extend between opposite extremities of the frame member, the key member preferably being sufficiently long for projecting simultaneously from opposite ends of the first passage, thereby facilitating movement of the key member between the first and second position. The first passage can be rectangularly cylindrical.

The connector passage can extend through the connector. Preferably the connector passage is openable for releasing the external device, whereby the pendant is selectively suspendable by the external device when the key member is moved between the first and second positions. Thus the pendant can be easily removed from the external device when the key member, together with the frame member, is being used for operating a lock. Alternatively, a loop portion of the connector can form the connector passage. The key member can be formed with a key passage that forms the locating surface.

Thus the present invention provides for a convenient and ornamental way to carry a spare tool such as a key on a person, the tool being locked within the pendant when not in use, the frame member and the tool member being rigidly connected when the tool member is in the usable position.

DRAWINGS

These and other features, aspects, and advantages of the present invention will become better understood with reference to the following description, appended claims, and accompanying drawings, where:

DESCRIPTION

Figure 7:
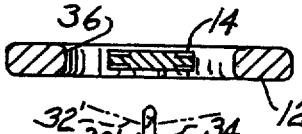
FIG. 7 is plan sectional view of the pendant of FIG. 1 on line 7—7 in FIG. 2.

The present invention is directed to a decorative tool pendant that provides a convenient to carry a spare tool such as a key on a person. With reference to FIGS. 1–8 of the drawings, the pendant 10 includes a frame member 12 having a first frame passage 14 and a second frame passage 16 extending therethrough. The pendant 10 also includes a tool or key member 18 that has an elongate cylindrical envelope 20, a tool surface 21 being formed within the envelope 20 for use on a workpiece. In the exemplary configuration of the pendant 10 shown in the drawings, the tool surface 21 is formed with a key profile 22 for unlocking a lock (not shown) when the key member 18 is operated with the lock, a locating surface in the form of a key passage 24 extending between opposite sides of the key member 18. Thus the key member 18 is engageable with the frame member 12 with portions of the key member 18 that are coincident with the cylindrical envelope 20 contacting the first frame passage 14 of the frame member 12. The key member is locatable with the key passage 24 aligned with the second frame passage 16 in a first position as indicated by the solid lines in FIG. 4, wherein at least a portion of the key profile 22 is located within a perimeter surface 26 of the frame member 12. The key member is also locatable in a second position as indicated by the dashed lines in FIG. 4, wherein the key profile 22 is fully exposed outside of the perimeter surface 26 for operating the lock.

Figure 2:
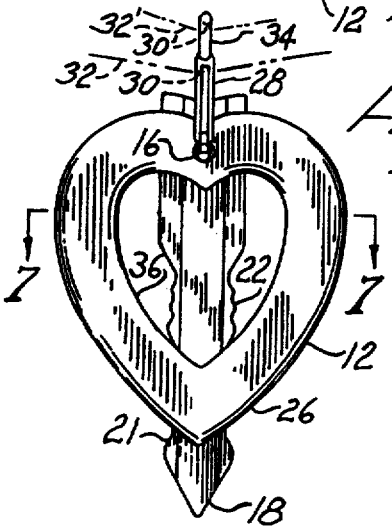
FIG. 2 is a front (or rear) elevational view of the pendant of FIG. 1.
Figure 3:
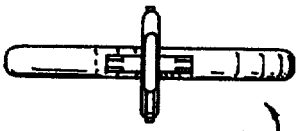
FIG. 3 is a top plan view of the pendant of FIG. 1.

The pendant 10 also includes a connector 28, which can be a conventional spring clasp, for selectively locking the key member 18 in one of the two positions, the key member 18 engaging the second frame passage 16 of the frame member 12 and the key passage 24 of the key member 18, a connector passage 30 extending through the pendant 10 for suspension thereof by an external device such as a conventional necklace 32 as depicted by dashed lines in FIG. 2. The connector passage 30 is openable for releasing the necklace 312, whereby the pendant 10 is selectively connectable to the necklace 32 for suspension therefrom when the key member 18 is being locked in one of the first and second positions. As shown in the drawings, a fixed counterpart of the connector passage, designated 30', is formed by a loop portion 34 of the connector 28 for more permanently engaging the connector 28 to the necklace 32 as indicated by dashed lines 32' in FIG. 2.

As shown in FIGS. 1, 2, 6 and 7, the frame member 12 has an opening 36 formed between opposite faces 38 thereof, the frame member 12 forming a closed loop about the opening 36,.the first frame passage 14 being interrupted by the opening 36 for partially exposing the key member 18 in the first position thereof. As shown in the drawings, an exemplary configuration of the frame member 12 has the perimeter surface 26 and the opening 36 heart-shaped for depicting an unlocked heart when the key member 18 is in the first position. Further, the faces 38 are approximately planar, being substantially parallel to the first frame passage 14, such that the key profile 22 faces toward a viewer when the pendant 10 is worn suspended by the necklace 32 against a wearer of the pendant 10.

Figure 8:
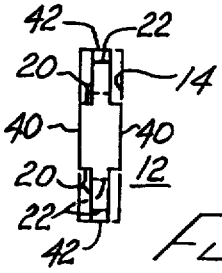
FIG. 8 is a detail bottom view of a portion of the pendant of FIG. 1.
Figure 5:
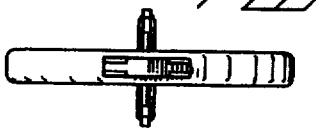
FIG. 5 is a bottom plan view of the pendant of FIG. 1.

As shown in FIGS. 3 and 5–8, the first frame passage 14 is cylindrical, the key member 18 being axially slidable within the first frame passage 14, the first frame passage 14 extending between opposite extremities of the frame member 12. More particularly, the first frame passage forms a rectangular opening of uniform cross-section. Preferably the key member 18 is sufficiently long to project simultaneously from opposite ends of the first frame passage 14, for facilitating movement of the key member 18 between the first and second positions. As best shown in FIG. 8, opposite side portions 40 and opposite edge portions 42 of the key member are coincident with the envelope 20, being in sliding contact with the first frame passage 14, the key member 18 being thinned on opposite sides terminating at the key profile 22 for compatibility with the lock to be opened by the pendant 10. Thus an exemplary configuration of the envelope 20 has a cross-section that is rectangular with notches at the corners thereof.

Figure 4:
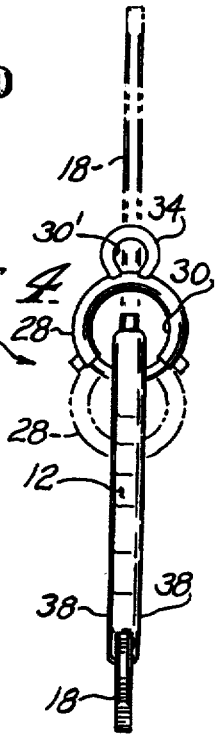
FIG. 4 is a right (or left) side elevational view of the pendant of FIG. 1.
Figure 1:
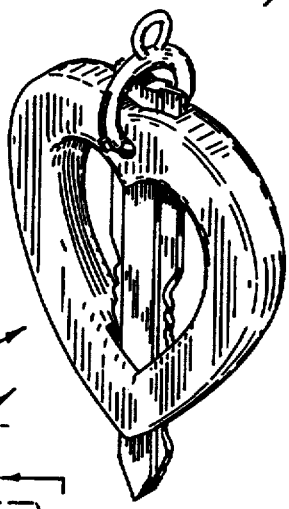
FIG. 1 is an oblique elevational perspective view of an ornamental tool pendant according to the present invention, the pendant being in a storage configuration.
Figure 6:
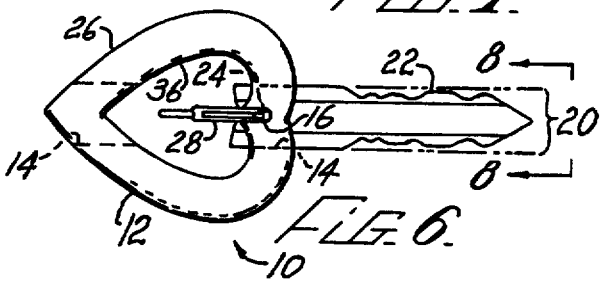
FIG. 6 is a front (or rear) view showing the pendant of FIG. 1 in an operating configuration.

In use, the pendant 10 is normally carried by the necklace 32 with the key member 18 in the first position as shown in FIGS. 1, 2 and solid lines in FIG. 4, the combination of the frame member 12 and the key member providing a desired ornamentation for a wearer. When it is desired to operate a lock with the key member 18, the connector 28 is disengaged from the key member 18 (and normally the frame member 12 as well), the key member 18 is then withdrawn from the frame 12, inverted endwise, and reinserted into the first frame passage 14, the key passage 24 being again aligned with the second frame passage 16, and the connecter 28 being reinstalled for locking the key member 18 in the second position as shown in FIG. 6 and dashed lines in FIG. 4. At this time, the necklace 32 can be taken out of the opening 30 as discussed above. The frame 12 thus forms a handle rigidly connected to the key member 18 for facilitating use of the pendant 10 for operating the lock.

Figure 9:
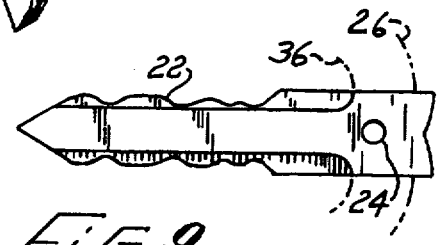
FIG. 9 is a front (or rear) view showing an alternative configuration of a portion of the pendant of FIG. 1.

With further reference to FIG. 9, an alternative configuration of the key member 18 has the side surfaces 40 and the edge surfaces 42 intersecting proximate the locating surface 24, away from the key profile 22. Thus the envelope 20 is rectangularly cylindrical.

Although the present invention has been described in considerable detail with reference to certain preferred versions thereof, other versions are possible. For example, the frame member 12 can be formed with other shapes of the perimeter surface 26 and the opening 36 for providing desired ornamental effects. In the configuration of the key member 18 of FIGS. 1–8, the first frame passage 14 can have a shape corresponding to the side surfaces 40 and the edge surfaces 42 of the key member 18, being of reduced cross section at the corners of the first frame passage 14 corresponding to the thinning of the key profile 22. Also, the first frame passage 14 is not required to completely enclose a region of the key member 18, whether on either or both sides of the opening 36. Similarly, the faces 38 need not be substantially planar as described above. Further, the key member can have a spaced pair of the key passages 24, and/or the frame 12 can have a spaced pair of the second frame passages 16 so that the key member need not be inverted endwise for movement between the first and second positions. Moreover, other possible configurations of the connector include a simple C-shaped or open triangularly shaped spring member, the connector passage being formed by the combination of the connector member and the frame member.

The tool member 18 can be a knife member wherein the tool surface 21 is a sharpened blade surface. Alternatively, the tool member 18 can be a file member, the tool surface 21 being formed as a nail file or the like. When the tool member 18 is a knife member or a file member, and end profile of the tool member 18 can be approximately flush with the perimeter surface 26 in the first position. Further, the pendant 10 can be provided with a plurality of the tool members 18. Therefore, the spirit and scope of the appended claims should not necessarily be limited to the description of the preferred versions contained herein.

What is claimed is:

1. A decorative tool pendant, comprising:

(a) a frame member having first and second intersecting passages extending therethrough, the first passage being cylindrical and extending between opposite extremities of the frame member;

(b) a tool member having an elongate cylindrical envelope and being axially slidable within the first passage, the tool member being sufficiently long for projecting simultaneously from opposite ends of the first passage, a tool surface being formed within the envelope for operation on a workpiece, a locating surface extending between opposite sides of the tool member, the tool member being engageable with the frame member with portions of the tool member that are coincident with the cylindrical envelope contacting the first passage of the frame member, the tool member being locatable with the locating surface aligned with the second passage of the frame member in a first position wherein at least a portion of the tool surface is located within a perimeter surface of the frame member, and a second position wherein the tool surface is fully exposed for operation on the workpiece; and (c) a connector for selectively retaining the tool member in one of the two positions, the connector engaging the second passage of the frame member and the locating surface of the tool member, a connector passage extending through the pendant for suspension thereof by an external device when the tool member is located in the first position by the connector.

2. The pendant of claim 1, wherein the frame member has an opening formed between opposite face portions of the perimeter surface, the first passage being interrupted by the opening for partially exposing the tool member in the first position thereof.

3. The pendant of claim 2, wherein the frame member forms a closed loop about the opening.

4. The pendant of claim 2, wherein the frame member is heart-shaped.

5. A decorative key pendant, comprising:

(a) a frame member having first and second intersecting passages extending therethrough, the first passage being cylindrical and extending between opposite extremities of the frame member;

(b) a key member having an elongate cylindrical envelope and being axially slidable within the first passage, the key member being sufficiently long for projecting simultaneously from opposite ends of the first passage, a key profile being formed within the envelope for unlocking a lock when the key member is operated with the lock, a locating surface extending between opposite sides of the key member, the key member being engageable with the frame member with portions of the key member that are coincident with the cylindrical envelope contacting the first passage of the frame member, the key member being locatable with the locating surface aligned with the second passage of the frame member in a first position wherein at least a portion of the key profile is located within a perimeter surface of the frame member, and a second position wherein the key profile is fully exposed for operating the lock; and (c) a connector for selectively retaining the key member in one of the two positions, the connector engaging the second passage of the frame member and the locating surface of the key member, a connector passage extending through the pendant for suspension thereof by an external device when the key member is located in the first position by the connector.

6. The pendant of claim 5, wherein the frame member has an opening formed between opposite face portions of the perimeter surface, the first passage being interrupted by the opening for partially exposing the key member in the first position thereof.

7. The pendant of claim 6, wherein the frame member forms a closed loop about the opening.

8. The pendant of claim 6, wherein the frame member is heart-shaped for depicting an unlocked heart when the key member is in the first position.

9. The pendant of claim 5, wherein the first passage is rectangularly cylindrical.

10. The pendant of claim 5, wherein the connector passage extends through the connector.

11. The pendant of claim 10, wherein the connector passage is openable for releasing the external device, whereby the pendant is selectively suspendable by the external device when the key member is moved between the first and second positions.

12. The pendant of claim 10, wherein a loop portion of the connector forms the connector passage.

13. The pendant of claim 5, wherein the key member is formed with a key passage, the key passage forming the locating surface.

14. A decorative key pendant, comprising:

(a) a frame member having opposite faces and a perimeter surface, first and second intersecting passages extending through the frame member, the first passage being cylindrical and extending between spaced locations of the perimeter surface;

(b) a key member having an elongate cylindrical envelope and being axially slidable within the first passage, the key member being sufficiently long for projecting simultaneously from opposite ends of the first passage, a key profile being formed within the envelope for unlocking a lock when the key member is operated with the lock, the key member being formed with a key passage, the key passage forming a locating surface extending between opposite sides of the key member, the key member being engageable with the frame member with portions of the key member that are coincident with the cylindrical envelope contacting the first passage of the frame member, the key member being locatable with the key passage aligned with the second passage of the frame member in a first position wherein at least a portion of the key profile is located within the perimeter surface of the frame member, and a second position wherein the key profile is fully exposed for operating the lock, the frame member having an opening formed between the opposite faces of the perimeter surface, the first passage being interrupted by the opening for partially exposing the key member in the first position thereof; and (c) a connector for selectively retaining the key member in one of the two positions, the connector engaging the second passage of the frame member and the key passage of the key member, a connector passage extending through the connector for suspension of the pendant by an external device when the key member is located in the first position by the connector.

* * * * *